US007179518B2

(12) United States Patent
Masuda

(10) Patent No.: US 7,179,518 B2
(45) **Date of Patent: *Feb. 20, 2007**

(54) PROTECTIVE LAYER TRANSFER FILM, INTERMEDIATE RECORDING MEDIUM AND PRINTED MATTER

(75) Inventor: Kazuhiro Masuda, Tokyo-To (JP)

(73) Assignee: Dai Nippon Printing Co., Ltd., Shinjuku-ku (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/121,296

(22) Filed: May 3, 2005

(65) Prior Publication Data

US 2005/0271863 A1 Dec. 8, 2005

(30) Foreign Application Priority Data

May 10, 2004 (JP) ..... 2004-139941
May 10, 2004 (JP) ..... 2004-139943

(51) Int. Cl.
*B41M 5/30* (2006.01)

(52) U.S. Cl. ..... 428/204; 428/195.1

(58) Field of Classification Search ..... 503/227
See application file for complete search history.

(56) References Cited

U.S. PATENT DOCUMENTS 6,737,152 B2 * 5/2004 Suzuki et al. ..... 428/195.1
6,815,397 B2 * 11/2004 Ishida et al. ..... 503/227

* cited by examiner

*Primary Examiner*—Bruce H. Hess
(74) *Attorney, Agent, or Firm*—Burr & Brown

(57) ABSTRACT

A protective layer transfer film and an intermediate transfer recording medium are disclosed, which can impart excellent fastness properties (durability), particularly excellent fastness to plasticizers and abrasion, to an image formed on an object. The protective layer transfer film includes a substrate film and a transfer part provided separably on the substrate film. The transfer part includes at least a plasticizer-resistant layer and a receptive layer on which an image is to be formed. The intermediate transfer recording medium is adapted for the transfer of the transfer part onto an object after the formation of an image on the receptive layer. The plasticizer-resistant layer is formed of an acrylic copolymer resin.

9 Claims, 2 Drawing Sheets

PROTECTIVE LAYER TRANSFER FILM, INTERMEDIATE RECORDING MEDIUM AND PRINTED MATTER

TECHNICAL FIELD

The present invention relates to a protective layer transfer film and a printed matter comprising an image onto which a protective layer has been transferred from the protective layer transfer film.

The present invention also relates to an intermediate transfer recording medium for use in a thermal transfer recording method of an intermediate transfer recording medium system, and a printed matter using the same.

BACKGROUND ART

Images, for example, gradation images and monotone images such as characters and symbols, have hitherto been formed on a substrate by a thermal transfer method. A thermal dye transfer (thermal sublimation transfer) method and a heat-fusion (thermal ink fusion) transfer method have been extensively used as the thermal transfer method.

In the thermal dye transfer method among these methods, a thermal transfer film comprising a substrate and a dye layer, formed of a material prepared by melting or dispersing a sublimable dye as a coloring material in a binder resin, supported on the substrate is provided, this thermal transfer film is put on top of an image-receiving sheet, energy corresponding to image information is applied to a heating device such as a thermal head to transfer the sublimable dye contained in the dye layer in the thermal transfer film onto the image-receiving sheet and thus to form an image.

This thermal dye transfer method is advantageous in that the amount of dye transferred can be regulated on a dot basis by the quantity of energy applied to the thermal transfer film and, thus, excellent gradation images can be formed and characters, symbols and the like can be simply formed.

At the present time, various cards such as identification cards, driving licenses, membership cards, and ID cards have become widely used. Various types of information about identification of the holder and the like are recorded in these cards. In particular, in ID cards and the like, in addition to textual information such as address and name, a photograph image of the face is important, and the image should remain unchanged or undeteriorated for a long period of time, that is, should have good fastness properties (durability).

At the present time, the above thermal dye transfer method is adopted in information recording in such cards. In the gradation image and monotone image formed by the above thermal dye transfer method, however, since the transferred dye is present on the surface of the object, the image is poor in fastness properties such as fastness to solvents and plasticizers. For this reason, in cards required to have good fastness properties, such as ID cards on which a photograph image of the face has been recorded, an attempt to improve fastness properties of the image has been made (for example, Japanese Patent Laid-Open Nos. 156567/1995 and 240404/2002).

Japanese Patent Laid-Open No. 156567/1995 discloses a protective layer transfer film comprising a thermally transferable resin layer provided on a substrate film, characterized in that the thermally transferable resin layer comprises a transparent resin layer, a plasticizer-resistant resin layer, and a heat-sensitive adhesive resin layer stacked in that order from the substrate film side. This publication describes that an acrylic copolymer resin is used in the plasticizer-resistant resin layer. Japanese Patent Laid-Open No. 240404/2002 discloses a protective layer transfer sheet comprising a thermally transferable protective layer provided on at least a part of one side of a substrate sheet. This protective layer is a laminate having a multilayer structure of at least two layers, that is, comprises at least a layer composed mainly of an acrylic resin and a layer composed mainly of a polyester resin provided in that order on the substrate sheet. The claimed advantage of this construction is to improve fastness to plasticizer, water, fading and the like.

Further, it should be noted that, when a printed matter (for example, ID card) is passed through a detecting machine or the like, the protective layer undergoes physical friction. In this case, from the viewpoint of preventing the protective layer from being easily damaged or separated, it is desired that the protective layer have good fastness to abrasion and good adhesion to an object.

The fastness properties, particularly fastness to plasticizers, abrasion and the like, of the image formed on the object, however, are not yet satisfactory, and a further improvement in these properties is desired.

On the other hand, in addition to a conventional direct printing method in which thermal transfer is carried out onto a thermal transfer image-receiving sheet, a method using an intermediate transfer recording medium is known as the thermal transfer recording method.

The thermal transfer recording method of an intermediate transfer recording medium system is known also as a sublimation retransfer method. As shown in FIG. 3, in this method, a thermal transfer film 12 and an intermediate transfer recording medium 13 are put on top of each other. Upon heating using a thermal head 14, a dye is transferred from the thermal transfer film 12 onto a receptive layer in the intermediate transfer recording medium to once form a printed image 16 on the intermediate transfer recording medium 13. The intermediate transfer recording medium with the image 16 printed thereon is put on top of an object 17. The assembly is heated by a heat roller 18 from the substrate side of the intermediate transfer recording medium to transfer the printed image 16 formed on the intermediate transfer recording medium onto the object 17, for example, a card.

As shown in FIG. 4, the intermediate transfer recording medium basically comprises a transfer part on a substrate film 121, the transfer part having a three layer structure comprising a peel layer 122, a durable layer 123, and a receptive layer 124 provided in that order on the substrate film 121. Upon the transfer of the printed image 16 onto an object 17, the peel layer and the layers overlying the peel layer are stacked onto the object.

At the present time, various cards such as identification cards, driving licenses, membership cards, and ID cards have become widely used. Various types of information about identification of the holder and the like are recorded in these cards. In particular, in ID cards and the like, in addition to textual information such as address and name, a photograph image of the face is important, and the image should remain unchanged or undeteriorated for a long period of time, that is, should have good fastness properties. To meet this demand, a durable layer is formed in the intermediate transfer recording medium (for example, Japanese Patent Laid-Open No. 254840/2002). The fastness properties, particularly fastness to plasticizers, abrasion and the like, of the image formed on the object, however, are not yet satisfactory, and a further improvement in these properties is desired.

DISCLOSURE OF THE INVENTION

Under these circumstances, the present invention has been made, and a first object of the present invention is to provide a protective layer transfer film which can realize a further improvement in fastness properties (durability) of an image formed on an object, particularly fastness to plasticizers and abrasion.

A second object of the present invention is to provide an intermediate transfer recording medium which can further improve fastness properties of an image formed on an object, particularly fastness to plasticizers and abrasion.

Specifically, according to a first invention, there is provided a protective layer transfer film comprising: a substrate film; and at least a plasticizer-resistant layer provided on said substrate film, said plasticizer-resistant layer being formed of an acrylic copolymer resin produced by radically polymerizing (a) 4 to 50 parts by weight of (meth)acrylic acid, (b) 4 to 40 parts by weight of 2-hydroxyethyl (meth) acrylate, (c) 0.1 to 2 parts by weight of polyethylene glycol di(meth)acrylate, and (d) 91.9 parts by weight of an unsaturated bond-containing compound (other than components (a) to (c)) ((a)+(b)+(c)+(d)=100 parts by weight).

The use of the protective layer transfer film according to the present invention can impart further improved fastness properties to an image formed on an object. Therefore, even when the object on which an image has been formed is brought into contact with a film such as a flexible plasticizer-containing vinyl chloride film over a long period of time, there is no fear of causing transfer of a part of the image onto the film. Further, in this case, the object on which a protective layer has been formed has excellent abrasion resistance, and the image having the same quality can be maintained for a long period of time.

According to a second invention, there is provided an intermediate transfer recording medium comprising: a substrate film; and at least a transfer part provided separably on said substrate film, said transfer part comprising a plasticizer-resistant layer formed of an acrylic copolymer resin produced by radically polymerizing (a) 4 to 50 parts by weight of (meth)acrylic acid, (b) 4 to 40 parts by weight of 2-hydroxyethyl (meth)acrylate, (c) 0.1 to 2 parts by weight of polyethylene glycol di(meth)acrylate, and (d) 8 to 91.9 parts by weight of an unsaturated bond-containing compound (other than components (a) to (c)) ((a)+(b)+(c)+(d) =100 parts by weight).

The use of the intermediate transfer recording medium according to the present invention can impart further improved fastness properties to an image formed on an object. Therefore, even when the object on which an image has been formed is brought into contact with a film such as a flexible plasticizer-containing vinyl chloride film over a long period of time, there is no fear of causing transfer of a part of the image onto the film. Further, in this case, the image on the object has excellent abrasion resistance, and the image having the same quality can be maintained for a long period of time.

BEST MODE FOR CARRYING OUT THE INVENTION

First Invention

Figure 1:
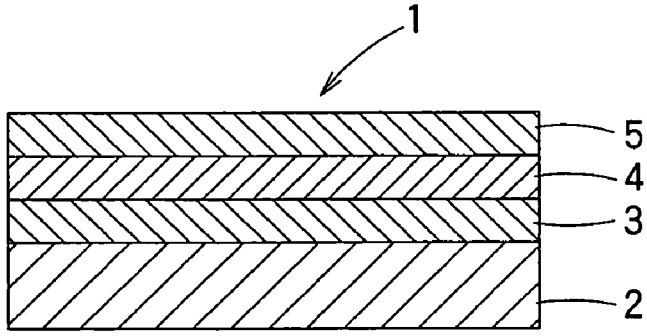
FIG. 1 is a typical cross-sectional view in one embodiment of the protective layer transfer film according to the present invention.

FIG. 1 is a typical cross-sectional view of one embodiment of the protective layer transfer film according to the present invention. In the drawing, a protective layer transfer film 1 includes a substrate film 2. A peel layer 3, a plasticizer-resistant layer 4, and a heat-sensitive adhesive resin layer 5 are provided in that order on one side of the substrate film 2. In the thermal transfer, the peel layer and the layers overlying the peel layer are transferred onto an object to constitute a protective layer.

The substrate film 1 may be the same substrate film as extensively used in this field and is not particularly limited. Specific examples of the substrate film include films of plastics, for example, highly heat resistant polyesters, such as polyethylene terephthalate, polyethylene naphthalate, polybutylene terephthalate, polyphenylene sulfide, polyether ketone, or polyether sulfone, and other plastics, such as polypropylene, polycarbonate, cellulose acetate, polyethylene derivative, polyvinyl chloride, polyvinylidene chloride, polystyrene, polyamide, polyimide, polymethylpentene, or ionomer, and laminates thereof. The plastic film may be a stretched or unstretched film. The thickness of the substrate film may be properly selected by taking into consideration, for example, strength, heat resistance and other properties. In general, however, the thickness of the substrate film is about 1 to 100 μm.

The peel layer 3 is formed of a binder resin. The binder resin may be selected from various conventional thermoplastic resins and heat-curable resins which have widely been used in the art.

Examples of thermoplastic resins usable herein include: acrylic resins, such as polymethacrylic acid, polymethacrylamide, polymethyl methacrylate, polyethyl methacrylate, and polybutyl acrylate; vinyl resins, such as polyvinyl acetate, vinyl chloride-vinyl acetate copolymer, polyvinyl alcohol, and polyvinylbutyral; and cellulose derivatives, such as ethylcellulose, nitrocellulose, and cellulose acetate.

Heat-curable resins usable herein include, for example, unsaturated polyester resins, polyester resins, polyurethane resins, and aminoalkyd resins.

Among these binder resins, acrylic resins are preferred.

These binder resins may be used either solely or as a mixture of two or more.

The peel layer may contain wax together with the binder resin. When the wax is contained, the scratch resistance and layer transferability of the peel layer can be improved.

Waxes include, for example, polyethylene wax, polyester wax, polystyrene powder, olefin powder, microcrystalline wax, carnauba wax, paraffin wax, Fischer-Tropsh wax, various low-molecular weight polyethylenes, Japan wax, beeswax, spermaceti, wool wax, shellac wax, candelilla wax, petrolactam, partially modified wax, fatty esters, and fatty amides.

The content of the wax in the peel layer is generally about 0.1 to 30% by weight, preferably about 0.1 to 10% by weight.

In the present invention, the peel layer may contain an ultraviolet absorber. The incorporation of the ultraviolet absorber can improve fastness to light and fastness to weathering of an image or the like of an object covered by a transferred protective layer.

Ultraviolet absorbers include conventional organic ultraviolet absorbers, for example, salicylate, benzophenone, benzotriazole, substituted acrylonitrile, nickel chelate, and hindered amine ultraviolet absorbers. An ultraviolet absorbing resin formed by introducing, for example, an addition-polymerizable double bond, such as a vinyl or acryloyl group or a methacryloyl group, or an alcoholic hydroxyl, amino, carboxyl, epoxy, isocyanate or other functional group, into the ultraviolet absorber may also be contained in the peel layer.

Further, various additives such as antioxidants and brightening agents may be contained in the peel layer. The peel layer may be formed by adding necessary additives such as wax to the binder resin, dissolving or dispersing the mixture in a solvent such as water or an organic solvent to prepare a composition, coating the composition onto the substrate film by a conventional coating method such as gravure printing, screen printing, reverse roll coating using a gravure plate or the like, and drying the coating.

The thickness of the peel layer is generally about 0.1 to 10 μm, preferably about 0.5 to 5 μm.

In the present invention, if necessary, a release layer may further be provided between the peel layer 3 and the substrate film 2.

When the separability of the substrate film from the protective layer is not proper, the release layer is provided to regulate the adhesion between the substrate film and the protective layer and to realize good separation of the protective layer.

The release layer is formed of, for example, various waxes such as silicone waxes, various resins such as silicone resins, fluororesins, acrylic resins, water-soluble resins, cellulose derivative resins, urethane resins, acetic acid-based vinyl resins, acryl vinyl ether resins, and maleic anhydride resins, and mixtures thereof.

The release layer may be formed by coating, onto a substrate film, a coating liquid containing at least one member selected from the group consisting of the above waxes and the above resins by a conventional coating method, and drying the coating. The thickness of the release layer is generally about 0.5 to 5.0 μm.

The release layer is preferably provided so that, upon transfer, the thermally transferable resin layer is separated from the peel layer, and the release layer per se stays on the substrate film side.

The plasticizer-resistant layer 4 is formed of an acrylic copolymer resin. In the present invention, the acrylic copolymer resin refers to a copolymer resin prepared by radically polymerizing a composition comprising (a) (meth) acrylic acid, (b) 2-hydroxyethyl (meth)acrylate, (c) polyethylene glycol di(meth)acrylate, and (d) a reactive unsaturated bond-containing compound other than the components (a), (b) and (c).

(a) (Meth)acrylic acid represents methacrylic acid or acrylic acid. In the present invention, methacrylic acid or acrylic acid may be used alone. Alternatively, a mixture of methacrylic acid with acrylic acid may be used.

(b) 2-Hydroxyethyl (meth)acrylate represents 2-hydroxyethyl methacrylate or 2-hydroxyethyl acrylate. In the present invention, 2-hydroxyethyl methacrylate or 2-hydroxyethyl acrylate may be used alone. Alternatively, a mixture of 2-hydroxyethyl methacrylate with 2-hydroxyethyl acrylate may also be used. "(Meth)acrylate" represents methacrylate or acrylate. The same shall apply hereinafter.

(c) Polyethylene glylcol di(meth)acrylate represents polyethylene glycol dimethacrylate or polyethylene glycol diacrylate. In the present invention, polyethylene glycol dimethacrylate or polyethylene glycol diacrylate may be used alone. Alternatively, a mixture of polyethylene glycol dimethacrylate with polyethylene glycol diacrylate may be used.

A divinyl monomer other than polyethylene glycol di(meth)acrylate may be used in such an amount that does not sacrifice the object of the present invention. Such divinyl monomers include, for example, divinylbenzene, diallyl phthalate, diallyl terephthalate, ethylene glycol di(meth) acrylate, propylene glycol di(meth)acrylate, polypropylene glycol di(meth)acrylate, tetramethylene glycol di(meth) acrylate, polytetramethylene glycol di(meth)acrylate, 1,6-hexanediol di(meth)acrylate, and neopentyl glycol di(meth) acrylate.

(d) The reactive unsaturated bond-containing compound other than the components (a), (b), and (c) is not particularly limited. Examples thereof include (meth)acrylic esters such as methyl (meth)acrylate, ethyl (meth)acrylate, propyl (meth)acrylate, n-butyl (meth)acrylate, i-butyl (meth)acrylate, t-butyl (meth)acrylate, 2-ethylhexyl (meth)acrylate, lauryl (meth)acrylate, stearyl (meth)acrylate, cyclohexyl (meth)acrylate, and benzyl (meth)acrylate; and nitrogen-containing vinyl monomers such as N,N-dimethylaminoethyl (meth)acrylate, N,N-diethylaminoethyl (meth)acrylate, (meth)acrylonitrile ("(meth)acrylonitrile" referred to as methacrylonitrile or acrylonitrile), and (meth) acrylamide ("(meth)acrylamide" referred to as methacrylamide or acrylamide); and examples of functional group-containing vinyl monomers include hydroxyl-containing vinyl monomers, such as hydroxypropyl (meth)acrylate, hydroxybutyl (meth)acrylate, an adduct of polycaprolactone with hydroxyethyl (meth)acrylate (Placcel F series: manufactured by Daicel Chemical Industries, Ltd.), an adduct of polyethylene glycol with methacrylic acid (Blemmer PE series: manufactured by Nippon Oils & Fats Co., Ltd.), and an adduct of polypropylene glycol with methacrylic acid (Blemmber PP series: manufactured by Nippon Oils & Fats Co., Ltd.);

carboxyl-containing vinyl monomers, such as maleic acid, maleic anhydride, and itaconic acid and monoesterification products thereof;

glycidyl-containing vinyl monomers, such as glycidyl (meth)acrylate, methylglycidyl (meth)acrylate, methyl glycidyl (meth)acrylate, and allylglycidyl (meth)acrylate; and other monomers, such as styrene, α-methylstyrene, vinyltoluene, vinyl acetate, vinyl propionate, ethylene, propylene, maleic anhydride, maleic acid, fumaric acid, and itaconic acid and monoesterification products thereof.

Component (d) may be used in a single compound form or in the form of a mixture of two or more compounds. Preferred compounds as component (d) are a (meth)acrylic ester or a mixed monomer composed of a (meth)acrylic ester and styrene.

The acrylic copolymer resin used in the present invention has been produced by radically polymerizing (a) 4 to 50 parts by weight of (meth)acrylic acid, (b) 4 to 40 parts by weight of 2-hydroxyethyl (meth)acrylate, (c) 0.1 to 2 parts by weight of polyethylene glycol di(meth)acrylate, and (d)

8 to 91.9 parts by weight of an unsaturated bond-containing compound (other than components (a) to (c)) ((a)+(b)+(c)+(d)=100 parts by weight).

(a) When the content of (meth)acrylic acid is in the range of 4 to 50% by mass, the contemplated good plasticizer resistance and abrasion resistance are provided.

(b) When the content of 2-hydroxyethyl (meth)acrylate is in the range of 4 to 40% by mass, the contemplated good plasticizer resistance is provided.

(c) When the content of polyethylene glycol di(meth) acrylate is in the range of 0.1 to 2% by mass, a good balance between plasticizer resistance and abrasion resistance can be realized.

(d) When the content of the reactive unsaturated bond-containing compound is in the range of 8 to 91.9, good film forming properties can be provided, and an improvement in plasticizer resistance and abrasion resistance can be realized.

The acrylic copolymer resin is preferably (a)/(b)/(c)/(d) =10 to 40/8 to 30/0.1 to 1.5/28.5 to 81.9 (% by mass), more preferably (a)/(b)/(c)/(d)=10 to 40/15 to 25/0.5 to 1.5/33.5 to 74.5 (% by mass).

The radical polymerization may be carried out using an initiator or the like by a conventional method so that the acrylic copolymer resin preferably has the following glass transition temperature and molecular weight.

In the acrylic copolymer resin used in the present invention, when the weight average molecular weight is less than 25000, the coating is brittle and lacks in hardness, abrasion resistance, and plasticizer resistance. In the present invention, the weight average molecular weight is a value as determined by gel permeation chromatography (GPC) using polystyrene as a standard.

The acrylic copolymer resin used in the present invention has a glass transition temperature (Tg1) of 50 to 90° C., preferably 50 to 80° C., as calculated from the monomer composition of the acrylic copolymer resin, and the difference between the glass transition temperature (Tg1) and a glass transition temperature (Tg2) as measured with a differential scanning calorimeter (DSC) (Tg2−Tg1) is 20° C. or above. When difference is less than 20° C., the abrasion resistance is lowered. When Tg1 is below 50° C., the coating is softened, while, when Tg1 is above 90° C., the flexibility of the coating is lowered. In both the cases, the plasticizer resistance is lowered.

The glass transition temperature Tg1 as calculated from the monomer composition of the acrylic copolymer resin may be determined by a conventional method, the Fox formula. The Fox formula is used for calculating Tg of a copolymer based on the Tgs of the homopolymers of respective monomers constituting the copolymer, and the details thereof are described in Bulletin of the American Physical Society, Series 2, Vol. 1, No. 3, p. 123 (1956). Regarding Tgs of various vinyl monomers which are the basis for calculating Tg1 of a copolymer according to the Fox formula, numerical values described, for example, in Shin Kobunshi Bunko (Novel Polymer Library), Vol. 7, Toryo yo Goseijushi Nyumon (Introduction to Synthetic Resins for Paints (Kyozo Kitaoka, published by Kobunshi Kankokai (Polymer Publishing Institute), Kyoto, 1974), pp. 168–169, Table 10-2 (main starting material monomers for acrylic resins for paints) may be used.

The glass transition temperature Tg2 as measured with a differential scanning calorimeter (DSC) is a value obtained with a measuring device DSC-60A, manufactured by Shimadzu Seisakusho Ltd. Specifically, the measurement is carried out as follows. 10 mg of a sample is accurately weighed and is pretreated, that is, is heated from 25° C. to 250° C. at a rate of 30° C./min and is cooled from 250° C. to 25° C. at a rate of 10° C./min. After the pretreatment, the sample is heated using alumina as a standard sample at a rate of 10° C./min, and a thermal change peak obtained at that time is regarded as the glass transition temperature Tg2. In the present invention, the glass transition temperature Tg2 is measured with a measuring device DSC-60A, manufactured by Shimadzu Seisakusho Ltd. However, it should be noted that values obtained by any measuring device may be used so far as the glass transition temperature may be measured by applying the same principle and law and the like and the same manner as described above.

The plasticizer-resistant layer is formed by dissolving or dispersing the above copolymer resin and other additives in a solvent such as water or an organic solvent to prepare a composition, coating the composition onto the substrate film or the peel layer provided on the substrate film by a conventional coating method such as gravure printing, screen printing, reverse roll coating using a gravure plate or the like, and drying the coating. The thickness of the plasticizer-resistant layer is generally about 0.1 to 10 μm, preferably about 0.5 to 5 μm.

The heat-sensitive adhesive resin layer 5 can improve the transferability and adhesion onto the printed matter as the object. The resin constituting the heat-sensitive adhesive resin layer may be any of resins incorporated in conventional pressure-sensitive adhesives, heat-sensitive adhesives and the like. However, thermoplastic resins having a glass transition temperature (Tg) of 50 to 80° C. are preferred. Specific examples of such thermoplastic resins include polyester resins, vinyl chloride-vinyl acetate copolymer resins, acrylic resins, butyral resins, epoxy resins, polyamide resins, vinyl chloride resins, and polyester-urethane resins.

The incorporation of the ultraviolet absorber in the heat-sensitive adhesive resin layer 5 can improve the light and weathering fastness of the image covered by the transferred protective layer. The above-described ultraviolet absorbers may be used as the ultraviolet absorber incorporated in the heat-sensitive adhesive resin layer 5. Further, additives such as antioxidants and brightening agents may also be incorporated.

The heat-sensitive adhesive resin layer is formed by dissolving or dispersing the above resin and other additives in a solvent such as water or an organic solvent to prepare a composition, coating the composition onto the plasticizer-resistant layer by a conventional coating method such as gravure printing, screen printing, reverse roll coating using a gravure plate or the like, and drying the coating. The thickness of the heat-sensitive adhesive resin is generally about 0.1 to 10 μm, preferably about 0.5 to 5 μm.

In the present invention, a backside layer may be provided on the substrate film in its side remote from the thermal transfer layer. The backside layer is provided to prevent heat fusing between a heating device such as a thermal head and a substrate film 2 and to improve slipperiness. The backside layer may be formed of a single resin or a mixture of two or more resins selected from naturally occurring or synthetic resins, for example, cellulosic resins, such as ethylcellulose, hydroxycellulose, hydroxypropylcellulose, methylcellulose, cellulose acetate, cellulose butyrate and nitrocellulose, vinyl resins, such as polyvinyl alcohol, polyvinyl acetate, polyvinyl butyral, polyvinyl acetal, and polyvinyl pyrrolidone, acrylic resins, such as polymethyl methacrylate, polyethyl acrylate, polyacrylamide, and acrylonitrile-styrene copolymer, polyamide resins, polyvinyltoluene resins, coumarone-indene resins, polyester resins, polyurethane resins, and silicone-modified or fluorine-modified urethane. In order to further enhance the heat resistance of the backside layer, preferably, among the above resins, a resin containing a reactive group based on a hydroxyl group (for example, butyral resins or acetal resins) is used in combination with polyisocyanate or the like as a crosslinking agent to form a crosslinked resin layer as the backside layer.

In order to impart slidability against the thermal head, a solid or liquid release agent or lubricant may be added to the backside layer to impart heat-resistant slipperiness to the backside layer. Release agents or lubricants include, for example, various waxes, such as polyethylene wax and paraffin wax, various surfactants, such as higher aliphatic alcohols, organopolysiloxanes, anionic surfactants, cationic surfactants, amphoteric surfactants, nonionic surfactants, fluorosurfactants, organic carboxylic acids and derivatives thereof, fluororesin, silicone resin, and fine particles of inorganic compounds such as talc, and silica. The content of the lubricant in the backside layer is about 5 to 50% by weight, preferably about 10 to 30% by weight.

The backside layer is formed by dissolving or dispersing the above resin and other additives in a solvent such as water or an organic solvent to prepare a composition, coating the composition onto the substrate film by a conventional coating method such as gravure printing, screen printing, reverse coating using a gravure plate or the like, and drying the coating. The thickness of the backside layer is generally about 0.1 to 10 μm, preferably about 0.5 to 5 μm.

The protective layer transfer film according to the present invention is not limited to the above embodiment and may be of any of a composite-type protective layer transfer film comprised of a thermally transferable protective layer and a thermally sublimable coloring material layer, a composite-type protective layer transfer film comprised of a thermally transferable protective layer and a heat-fusion coloring material layer and the like which may be properly selected depending upon the purpose of use and the like. In the former composite-type protective layer transfer film, when an object has a dye-receptive layer, image formation and transfer of the protective layer onto the object can be simultaneously carried out by thermal transfer.

For example, a protective layer transfer film comprising a thermally transferable protective layer and at least one coloring material layer selected from the group consisting of a thermally sublimable coloring material layer and a heat-fusion coloring material layer provided in a face serial manner on one side of a substrate film may be mentioned as an embodiment of the protective layer transfer film.

Figure 2:
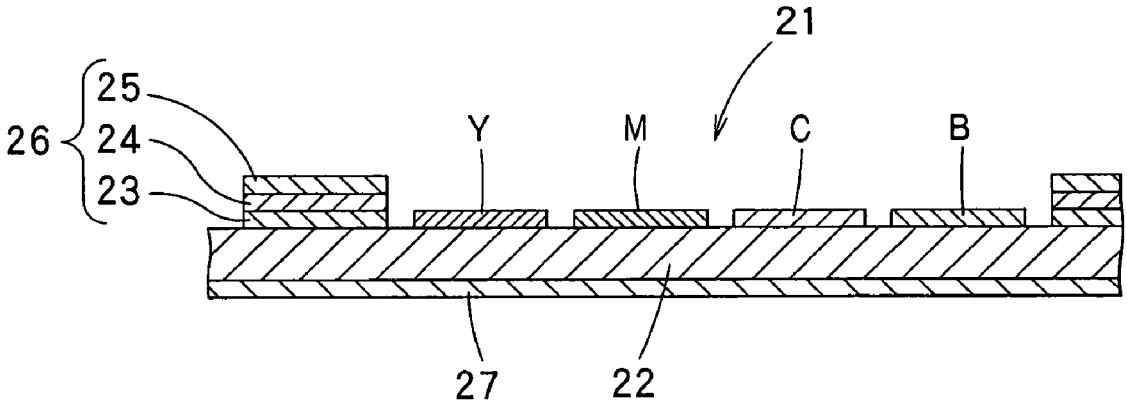
FIG. 2 is a typical cross-sectional view in one embodiment of the protective layer transfer film according to the present invention.

FIG. 2 is a typical cross-sectional view showing another embodiment of the protective layer transfer film according to the present invention. As shown in FIG. 2, in a protective layer transfer film 21 according to the present invention, a thermally sublimable coloring material layer Y, a thermally sublimable coloring material layer M, a thermally sublimable coloring material layer C, a thermally sublimable coloring material layer B, and a thermally transferable protective layer 26 are provided on one side of the substrate film 22 in a face serial manner, and a backside layer 27 is provided on the other side of the substrate film 22. The thermally transferable protective layer 26 comprises, for example, a peel layer 23, a plasticizer-resistant layer 24, and a heat-sensitive adhesive resin layer 25.

In FIG. 2, heat-fusion coloring material layers Y, M, C, B may be used instead of the thermally sublimable coloring material layers Y, M, C, B. Further, these two types of layers may be provided in a mixed state, that is, an alternately or randomly face-serially arranged state.

The object on which a protective layer is transferred from the protective layer transfer film according to the present invention is not particularly limited.

The object may be a sheet formed of any substrate such as plain paper, wood free paper, tracing paper, plastic films or the like. The object may also be in the form of any of cards, postal cards, passports, letter papers or writing pads, report pads, notebooks, and catalogs or the like.

Specific examples of objects in the present invention include: gold notes, such as stock certificates, securities, deeds, passbooks, railway tickets, streetcar tickets, stamps, postage stamps, appreciation tickets, admission tickets, and other tickets; cards, such as bank cards, credit cards, prepaid cards, membership cards, greeting cards, postcards, business cards, driver's licenses, IC cards, and optical cards; cases, such as cartons and containers; bags; forms control; envelops; tags; OHP sheets; slide films; bookmarks; calendars; posters; pamphlets; menus; passports; POP goods; coasters; displays; name plates; keyboards; cosmetics; accessories such as wristwatches and lighters; stationeries such as report pads or writing materials; building materials; panels; emblems; keys; cloths; clothes; footwears; equipment or devices such as radios, televisions, electronic calculators, and OA equipment; various sample or pattern books; albums; and outputs of computer graphics and outputs of medical images.

The image may be formed on the object by any of electrophotography, ink jet recording, thermal transfer recording and the like.

The thermally sublimable coloring material layer comprises a dye, which is mainly thermally transferable by sublimation, supported, for example, on a binder resin.

In this case, any conventional dye commonly used in thermal transfer films can be effectively used, and the dye is not particularly limited. The following dyes may be mentioned as preferred dyes. Specifically, for example, MS Red G, Macrolex Red Violet R, Ceres Red 7B, Samaron Red HBSL, and Resolin Red F 3BS may be mentioned as magenta dyes. For example, Phorone Brilliant Yellow 6 GL, PTY-52, Macrolex Yellow 6G and the like may be mentioned as yellow dyes. For example, Kayaset Blue 714, Waxoline Blue AP-FW, Phorone Brilliant Blue S-R, and MS Blue 100 may be mentioned as cyan dyes.

Any conventional binder resin may be used for supporting the above dyes, and examples of preferred binder resins include: cellulosic resins such as ethylcellulose, hydroxyethylcellulose, ethylhydroxycellulose, hydroxypropylcellulose, methylcellulose, cellulose acetate, and cellulose butyrate; vinyl resins such as polyvinyl alcohol, polyvinyl acetate, polyvinyl butyral, polyvinyl acetal, polyvinyl pyrrolidone, and polyacrylamide; and polyester resins. Among them, for example, cellulosic resins, vinyl resins such as polyvinyl butyral and polyvinyl acetal, and polyester resins are preferred from the viewpoints of heat resistance, transferability of dyes and the like.

Further, if necessary, various conventional other additives may be incorporated into the thermally sublimable coloring material layer.

The content of the dye is generally about 5 to 90% by weight, preferably about 10 to 70% by weight, based on the total amount of the thermally sublimable coloring material layer.

The thermally sublimable coloring material layer is preferably formed by adding the above sublimable dye, binder resin, and other optional components to a suitable solvent for dissolution or dispersion to prepare a coating material or composition for thermally sublimable coloring material layer formation, coating the coating material or composition onto the above substrate film in a face serial manner and drying the coating.

The thickness of the thermally sublimable coloring material layer is generally about 0.2 to 5 μm, preferably about 0.4 to 2 μm.

The heat-fusion coloring material layer comprises a colorant supported on a binder.

Among organic or inorganic pigments and dyes, those having good properties as a recording material, for example, those, which have satisfactory color density and do not cause color change and fading upon exposure to light, heat, and temperature or the like, are preferred as the colorant. For example, colorants having black, cyan, magenta, yellow, and other hues are usable as such colorants.

The binder used is, for example, composed mainly of wax and further comprises a mixture of a drying oil, a resin, a mineral oil, a cellulose derivative, and a rubber derivative.

Waxes usable herein include various waxes such as microcrystalline wax, carnauba wax, paraffin wax, Fischer-Tropsh wax, various types of low-molecular weight polyethylene, Japan wax, beeswax, spermaceti, insect wax, wool wax, shellac wax, candelilla wax, petrolactum, polyester wax, partially modified wax, fatty esters, and fatty amides.

A vinyl chloride-vinyl acetate copolymer resin, an acrylic resin, a chlorinated rubber, a vinyl chloride-vinyl acetate copolymer resin, a cellulosic resin or the like may also be used as the binder.

The heat-fusion coloring material layer may be formed, for example, by adding the above colorant, binder resin, and optionally other additives to prepare a composition for heat-fusion coloring material layer formation, coating the composition onto the above substrate film by hot melt coating, hot lacquer coating, gravure coating, gravure reverse coating, knife coating, air coating, roll coating or the like and drying the coating.

The thickness of the heat-fusion coloring material layer is generally about 0.1 to 8 μm, preferably about 0.4 to 2 μm.

The heat-fusion coloring material layer formed on the substrate film may have a single-layer structure or a multi-layer structure of two or more layers.

In the present invention, a primer layer may be provided between the substrate film and the thermally sublimable coloring material layer. Further, in the present invention, a peel layer may be provided between the substrate film and the heat-fusion coloring material layer. This peel layer may be the same as the above-described peel layer.

In using the protective layer transfer film according to the present invention, the conventional method for using a protective layer transfer film as such may be adopted. For example, a method may be adopted in which the protective layer transfer film according to the present invention is put on top of an object so that the heat-sensitive adhesive resin layer surface faces the object, followed by thermal transfer of the thermally transferable resin layer onto the object.

Second Invention

Figure 3:
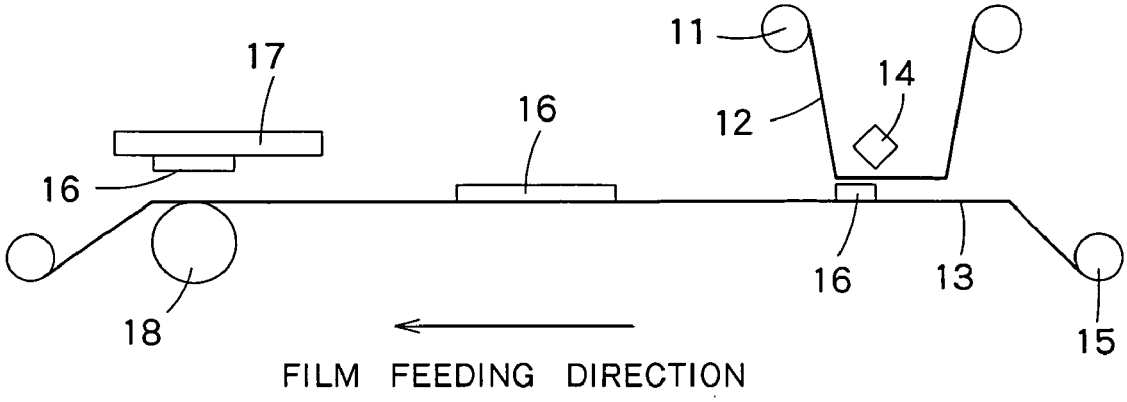
FIG. 3 is a typical block diagram illustrating a thermal transfer recording method of an intermediate transfer recording medium system.
Figure 4:
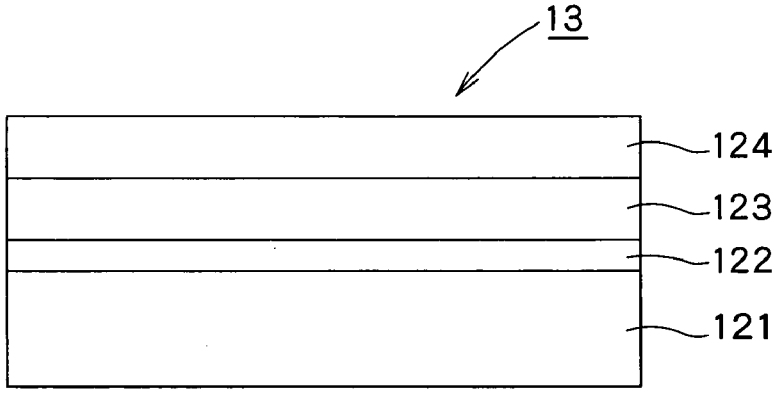
FIG. 4 is a typical cross-sectional view in one embodiment of the intermediate transfer recording medium according to the present invention.
Figure 5:
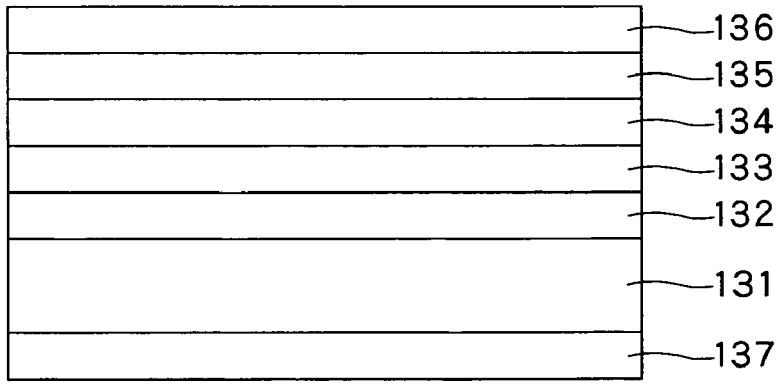
FIG. 5 is a typical cross-sectional view in one embodiment of the intermediate transfer recording medium according to the present invention.

The second invention will be described with reference to one embodiment of an intermediate transfer recording medium. FIG. 3 is a typical cross-sectional view of the embodiment of an intermediate transfer recording medium. In the intermediate transfer recording medium shown in FIG. 3, a release layer 132, a peel layer 133, a plasticizer-resistant layer 134, a primer layer 135, and a receptive layer 146 are provided on a substrate film 131, and a heat-resistant slip layer 147 is provided on the opposite surface of the substrate film 131. These layers may be formed by coating using conventional formation means such as gravure printing, screen printing, or reverse roll coating using a gravure plate, and drying the coating.

The substrate film 131 for constituting the intermediate transfer recording medium may be a substrate film commonly used in conventional thermal transfer films. Specific examples of preferred substrate films include: thin paper, such as capacitor paper, glassine paper, or paraffin-waxed paper; or stretched or unstretched films or sheets of plastics, for example, highly heat resistant polyesters, such as polyethylene terephthalate, polybutylene terephthalate, polyphenylene sulfide, polyether ketone, polyether sulfone, or polyethylene naphthalate, and other plastics, such as polypropylene, polycarbonate, cellulose acetate, polyethylene derivative, polyvinyl chloride, polyvinylidene chloride, polystyrene, polyamide, polyimide, polymethylpentene, or ionomer. Composite/laminated films of these materials may also be used. The surface of these materials may be subjected to bonding treatment. The thickness of the substrate may be properly selected according to the material so as to provide proper strength and heat resistance. However, the thickness of the substrate is 1 to 100 μm, preferably 1.5 to 50 μm.

The release layer 132 is used for smoothly separating the substrate from the peel layer at the time of retransfer and optionally may be provided. When the peel layer can be smoothly separated from the substrate, the provision of the release layer 132 is not always required. The release layer contains a binder resin and a release material. Binder resins usable herein include: thermoplastic resins, for example, acrylic resins such as polymethyl methacrylate, polyethyl methacrylate, and polybutyl acrylate, vinyl resins such as polyvinyl acetate, vinyl chloride-vinyl acetate copolymer, polyvinyl alcohol, and polyvinyl butyral, and cellulose derivatives such as ethylcellulose, nitrocellulose, and cellulose acetate; or heat-curable resins such as unsaturated polyester resins, polyester resins, polyurethane resins, and aminoalkyd resins. Release materials include waxes, silicone waxes, silicone resins, melamine resins, fluororesins, finely divided talc or silica, and lubricants such as surfactants and metallic soaps. The release layer may also be formed of a material prepared by grafting copolymerizing the binder resin and the release material. The coverage of the release layer is preferably 0.1 to 15 g/m$^2$, more preferably 0.2 to 10 g/m$^2$, on a dry basis.

The peel layer optionally provided between the receptive layer and the substrate for protecting the receptive layer transferred onto the object is transferred together with the receptive layer at the time of retransfer of the intermediate transfer recording medium on an object. As a result, the peel layer is located on the outermost surface of the receptive layer having an image transferred onto the object and can contribute to an improvement in weathering fastness of the image, as well as in fastness properties to fingerprints and chemicals or the like. The peel layer is formed by selecting a resin composition that has suitable strength of adhesion to the substrate or the release layer and, at the same time, has desired properties as a surface protective layer for the receptive layer after transfer of the peel layer together with the receptive layer with an image formed thereon onto an object.

In general, the peel layer may be formed of thermoplastic resins, for example, cellulose derivatives such as ethylcellulose, nitrocellulose, and cellulose acetate, acrylic resins such as polymethyl methacrylate, polyethyl methacrylate, and polybutyl acrylate, vinyl polymers such as polyvinyl chloride, vinyl chloride-vinyl acetate copolymer, and polyvinyl butyral, or heat-curable resins such as unsaturated polyester resins, polyurethane resins, and aminoalkyd resins. The peel layer may be formed of an acrylic copolymer resin which will be described later. The coverage of the peel layer is preferably 0.1 to 20 g/m$^2$, more preferably 0.2 to 10 g/m$^2$, on a dry basis.

The plasticizer-resistant layer 134 is formed of an acrylic copolymer resin. The plasticizer-resistant layer 134 can further improve fastness properties, particularly fastness to plasticizer and fastness to abrasion, of an image formed on an object. In the present invention, the acrylic copolymer resin refers to a copolymer resin prepared by radically polymerizing a composition comprising (a) (meth)acrylic acid, (b) 2-hydroxyethyl (meth)acrylate, (c) polyethylene glycol di(meth)acrylate, and (d) a reactive unsaturated bond-containing compound other than the components (a), (b) and (c).

(a) (Meth)acrylic acid represents methacrylic acid or acrylic acid. In the present invention, methacrylic acid or acrylic acid may be used alone. Alternatively, a mixture of methacrylic acid with acrylic acid may be used.

(b) 2-Hydroxyethyl (meth)acrylate represents 2-hydroxyethyl methacrylate or 2-hydroxyethyl acrylate. In the present invention, 2-hydroxyethyl methacrylate or 2-hydroxyethyl acrylate may be used alone. Alternatively, a mixture of 2-hydroxyethyl methacrylate with 2-hydroxyethyl acrylate may also be used. "(Meth)acrylate" represents methacrylate or acrylate. The same shall apply hereinafter.

(c) Polyethylene glylcol di(meth)acrylate represents polyethylene glycol dimethacrylate or polyethylene glycol diacrylate. In the present invention, polyethylene glycol dimethacrylate or polyethylene glycol diacrylate may be used alone. Alternatively, a mixture of polyethylene glycol dimethacrylate with polyethylene glycol diacrylate may be used.

A divinyl monomer other than polyethylene glycol di(meth)acrylate may be used in such an amount that does not sacrifice the object of the present invention. Such divinyl monomers include, for example, divinylbenzene, diallyl phthalate, diallyl terephthalate, ethylene glycol di(meth) acrylate, propylene glycol di(meth)acrylate, polypropylene glycol di(meth)acrylate, tetramethylene glycol di(meth) acrylate, polytetramethylene glycol di(meth)acrylate, 1,6-hexanediol di(meth)acrylate, and neopentyl glycol di(meth) acrylate.

(d) The reactive unsaturated bond-containing compound other than the components (a), (b), and (c) is not particularly limited. Examples thereof include (meth)acrylic esters such as methyl (meth)acrylate, ethyl (meth)acrylate, propyl (meth)acrylate, n-butyl (meth)acrylate, i-butyl (meth)acrylate, t-butyl (meth)acrylate, 2-ethylhexyl (meth)acrylate, lauryl (meth)acrylate, stearyl (meth)acrylate, cyclohexyl (meth)acrylate, and benzyl (meth)acrylate; and nitrogen-containing vinyl monomers such as N,N-dimethylaminoethyl (meth)acrylate, N,N-diethylaminoethyl (meth)acrylate, (meth)acrylonitrile ("(meth)acrylonitrile" referred to as methacrylonitrile or acrylonitrile), and (meth) acrylamide ("(meth)acrylamide" referred to as methacrylamide or acrylamide); and examples of functional group-containing vinyl monomers include hydroxyl-containing vinyl monomers, such as hydroxypropyl (meth)acrylate, hydroxybutyl (meth)acrylate, an adduct of polycaprolactone with hydroxyethyl (meth)acrylate (Placcel F series: manufactured by Daicel Chemical Industries, Ltd.), an adduct of polyethylene glycol with methacrylic acid (Blemmer PE series: manufactured by Nippon Oils & Fats Co., Ltd.), and an adduct of polypropylene glycol with methacrylic acid (Blemmber PP series: manufactured by Nippon Oils & Fats Co., Ltd.);

carboxyl-containing vinyl monomers, such as maleic acid, maleic anhydride, and itaconic acid and monoesterification products thereof;

glycidyl-containing vinyl monomers, such as glycidyl (meth)acrylate, methylglycidyl (meth)acrylate, methyl glycidyl (meth)acrylate, and allylglycidyl (meth)acrylate; and other monomers, such as styrene, α-methylstyrene, vinyltoluene, vinyl acetate, vinyl propionate, ethylene, propylene, maleic anhydride, maleic acid, fumaric acid, and itaconic acid and monoesterification products thereof.

Component (d) may be used in a single compound form or in the form of a mixture of two or more compounds. Preferred compounds as component (d) are a (meth)acrylic ester or a mixed monomer composed of a (meth)acrylic ester and styrene.

The acrylic copolymer resin used in the present invention has been produced by radically polymerizing (a) 4 to 50 parts by weight of (meth)acrylic acid, (b) 4 to 40 parts by weight of 2-hydroxyethyl (meth)acrylate, (c) 0.1 to 2 parts by weight of polyethylene glycol di(meth)acrylate, and (d) 8 to 91.9 parts by weight of an unsaturated bond-containing compound (other than components (a) to (c)) ((a)+(b)+(c)+(d)=100 parts by weight).

(a) When the content of (meth)acrylic acid is in the range of 4 to 50% by mass, the contemplated good plasticizer resistance and abrasion resistance are provided.

(b) When the content of 2-hydroxyethyl (meth)acrylate is in the range of 4 to 40% by mass, the contemplated good plasticizer resistance is provided.

(c) When the content of polyethylene glycol di(meth) acrylate is in the range of 0.1 to 2% by mass, a good balance between plasticizer resistance and abrasion resistance can be realized.

(d) When the content of the reactive unsaturated bond-containing compound is in the range of 8 to 91.9, good film forming properties can be provided, and an improvement in plasticizer resistance and abrasion resistance can be realized.

The acrylic copolymer resin is preferably (a)/(b)/(c)/(d) =10 to 40/8 to 30/0.1 to 1.5/28.5 to 81.9 (% by mass), more preferably. (a)/(b)/(c)/(d)=10 to 40/15 to 25/0.5 to 1.5/33.5 to 74.5 (% by mass).

The radical polymerization may be carried out using an initiator or the like by a conventional method so that the acrylic copolymer resin preferably has the following glass transition temperature and molecular weight.

In the acrylic copolymer resin used in the present invention, when the weight average molecular weight is less than 25000, the coating is brittle and lacks in hardness, abrasion resistance, and plasticizer resistance. In the present invention, the weight average molecular weight is a value as determined by gel permeation chromatography (GPC) using polystyrene as a standard.

The acrylic copolymer resin used in the present invention has a glass transition temperature (Tg1) of 50 to 90° C., preferably 50 to 80° C., as calculated from the monomer composition of the acrylic copolymer resin, and the difference between the glass transition temperature (Tg1) and a glass transition temperature (Tg2) as measured with a differential scanning calorimeter (DSC) (Tg2−Tg1) is 20° C. or above. When the difference is less than 20° C., the abrasion resistance is lowered. When Tg1 is below 50° C., the coating is softened, while, when Tg1 is above 90° C., the flexibility of the coating is lowered. In both the cases, the plasticizer resistance is lowered.

The glass transition temperature Tg1 as calculated from the monomer composition of the acrylic copolymer resin may be determined by a conventional method, the Fox formula. The Fox formula is used for calculating Tg of a copolymer based on the Tgs of the homopolymers of respective monomers constituting the copolymer, and the details thereof are described in Bulletin of the American Physical Society, Series 2, Vol. 1, No. 3, p. 123 (1956). Regarding Tgs of various vinyl monomers which are the basis for calculating Tg1 of a copolymer according to the Fox formula, numerical values described, for example, in Shin Kobunshi Bunko (Novel Polymer Library), Vol. 7, Toryo yo Goseijushi Nyumon (Introduction to Synthetic Resins for Paints (Kyozo Kitaoka, published by Kobunshi Kankokai (Polymer Publishing Institute), Kyoto, 1974), pp. 168-169, Table 10-2 (main starting material monomers for acrylic resins for paints) may be used.

The glass transition temperature Tg2 as measured with a differential scanning calorimeter (DSC) is a value obtained with a measuring device DSC-60A, manufactured by Shimadzu Seisakusho Ltd. Specifically, the measurement is carried out as follows. 10 mg of a sample is accurately weighed and is pretreated, that is, is heated from 25° C. to 250° C. at a rate of 30° C./min and is cooled from 250° C. to 25° C. at a rate of 10° C./min. After the pretreatment, the sample is heated using alumina as a standard sample at a rate of 10° C./min, and a thermal change peak obtained at that time is regarded as the glass transition temperature Tg2. In the present invention, the glass transition temperature Tg2 is measured with a measuring device DSC-60A, manufactured by Shimadzu Seisakusho Ltd. However, it should be noted that values obtained by any measuring device may be used so far as the glass transition temperature may be measured by applying the same principle and law and the like and the same manner as described above.

The plasticizer-resistant layer is formed by dissolving or dispersing the above copolymer resin and other additives in a solvent such as water or an organic solvent to prepare an ink, coating the ink onto the substrate film or the peel layer provided on the substrate film by a conventional coating method such as gravure printing, screen printing or reverse roll coating using a gravure plate, and drying the coating. The thickness of the plasticizer-resistant layer is generally 0.1 to 25 g/m$^2$, preferably 0.2 to 15 g/m$^2$, on a dry basis.

The primer layer 135 which optionally may be provided functions to enhance the adhesion between the substrate film and the resin or between the resins. Since the primer layer is provided from the viewpoint of imparting necessary adhesion, the position of the primer layer is not particularly limited. Examples of resins usable for constituting the primer layer include resins having good adhesion, for example, polyester resins, polyacrylic resins, polyurethane resins, polyamide resins, vinyl resins such as polyvinyl alcohol resins, polyvinyl acetate resins, and polyvinyl pyrrolidone resins, polyethylene resins, and polypropylene resins. The coverage is preferably 0.1 to 10 g/m$^2$ on a dry basis. Corona discharge treatment, plasma treatment and the like may also be carried out and may be carried out in combination with coating of a primer resin.

The receptive layer is preferably formed of a resin which is easily dyeable with a sublimation dye. Examples of such resins include: polyolefin resins such as polypropylene; halogenated resins such as polyvinyl chloride, polyvinylidene chloride, or polyvinyl chloride-vinyl acetate copolymers; vinyl resins such as polyvinyl acetate and polyacrylic esters; polyester resins such as polyethylene terephthalate or polybutylene terephthalate; polystyrene resins; polyamide resins; resins of copolymers of olefins, such as ethylene or propylene, with other vinyl monomers; ionomers; and cellulose derivatives. They may be used either solely or as a mixture of two or more. Among them, vinyl resins and polyester resins are particularly preferred. An image may be formed on the receptive layer by electrophotography or ink jet recording.

Regarding the receptive layer, a release agent is preferably incorporated in the above resin from the viewpoint of preventing heat fusing, between the receptive layer and the coloring material layer in the thermal transfer film, in the formation of a dye image in the receptive layer. Release agents usable herein include silicone oils, phosphoric ester surfactants, and fluoro compounds. Among them, silicone oils are particularly preferred. The amount of the release agent added is preferably 0.2 to 30 parts by weight based on 100 parts by weight of the resin for receptive layer formation. The coverage of the receptive layer is preferably 0.1 to 10 g/m$^2$ on a dry basis.

A heat-resistant slip layer 137 may be provided on one side of the intermediate transfer recording medium from the viewpoint of preventing adverse effect such as sticking, cockling of prints or the like caused by heat of a thermal head. The resin for heat-resistant slip layer formation may be any conventional resin, and examples thereof include polyvinylbutyral resins, polyvinylacetoacetal resins, polyester resins, vinyl chloride-vinyl acetate copolymers, polyether resins, polybutadiene resins, styrene-butadiene copolymers, acrylic polyols, polyurethane acrylates, polyester acrylates, polyether acrylates, epoxy acrylates, urethane or epoxy prepolymers, nitrocellulose resins, cellulose nitrate resins, cellulose acetopropionate resins, cellulose acetate butyrate resins, cellulose acetate hydrogenphthalate resins, cellulose acetate resins, aromatic polyamide resins, polyimide resins, polyamide-imide resins, polycarbonate resins, and chlorinated polyolefin resins.

Slipperiness-imparting agents added to or coated onto the top of the heat-resistant slip layer formed of these resins include phosphoric esters, metallic soaps, silicone oils, graphite powders, silicone graft polymers, fluoro graft polymers, acrylic silicone graft polymers, acrylsiloxanes, arylsiloxanes, and other silicone polymers. Preferably, the heat-resistant slip layer is formed of a polyol, for example, a polyalcohol polymer compound, a polyisocyanate compound, or a phosphoric ester compound. Further, the addition of a filler is more preferred.

The heat-resistant slip layer may be formed by dissolving or dispersing the above resin, slipperiness-imparting agent, and filler in a suitable solvent to prepare a coating liquid for a heat-resistant slip layer, coating the coating liquid onto the substrate film, for example, by the same means for the formation of other layers, such as gravure printing, screen printing, or reverse roll coating using a gravure plate, and drying the coating. The coverage of the heat-resistant slip layer is preferably 0.1 to 3.0 g/m$^2$ on a dry basis. The primer layer as described above may be provided between the heat-resistant slip layer and the substrate film.

The present invention will be described with reference to the following examples. In the following Examples, "parts" or "%" is by mass unless otherwise specified.

EXAMPLES

Examples A

Preparation of Protective Layer Transfer Film

Examples A1 to A8 and Comparative Examples A1 to A9

(Formation of Backside Layer)

A 6 μm-thick polyethylene terephthalate film (manufactured by Toray Industries, Inc.) subjected to easy-adhesion treatment was provided. A composition for a backside layer having the following composition was gravure coated (coverage: 1.0 g/m$^2$ on a dry basis) onto one side of the polyethylene terephthalate film, and the coating was dried, followed by curing to form a backside layer.

| | |
|---|---|
| Polyvinyl butyral (S-lec BX-1, manufactured by Sekisui Chemical Co., Ltd.) | 15 pts. wt. |
| Polyisocyanate (Burnock D450, manufactured by Dainippon Ink and Chemicals, Inc.) | 35 pts. wt. |
| Phosphate surfactant (Plysurf A 208 S, manufactured by Dai-Ichi Kogyo Seiyaku Co., Ltd.) | 10 pts. wt. |
| Talc (Microace P-3, manufactured by Nippon Talc Co., Ltd.) | 3 pts. wt. |

(Formation of Release Layer)

A composition for a release layer having the following composition was then gravure coated (coverage: 0.7 g/m$^2$ on a dry basis) onto the surface of polyethylene terephthalate film remote from the backside layer, and the coating was dried to form a release layer.

| | |
|---|---|
| Silicone-modified acrylic resin (CELTOP 226, manufactured by Daicel Chemical Industries, Ltd.; solid content 50%) | 16 pts. wt. |
| Aluminum catalyst (CELTOP CAT-A, manufactured by Daicel Chemical Industries, Ltd.; solid content 10%) | 3 pts. wt. |
| Methyl ethyl ketone | 8 pts. wt. |
| Toluene | 8 pts. wt. |

(Formation of Peel Layer)

A composition for a peel layer having the following composition was gravure coated onto the release layer to a thickness of 1.0 μm on a dry basis, and the coating was dried to form a peel layer.

| | |
|---|---|
| Acrylic resin (BR-85, manufactured by Mitsubishi Rayon Co., Ltd.) | 40 pts. wt. |
| Polyester resin (Vylon 200, manufactured by Toyobo Co., Ltd.) | 2 pts. wt. |
| Methyl ethyl ketone | 50 pts. wt. |
| Toluene | 50 pts. wt. |

(Formation of Plasticizer-Resistant Layer)

A copolymer shown in Table A1 was synthesized. A composition for a plasticizer-resistant layer containing the copolymer and having the following composition was gravure coated onto the peel layer to a thickness of 1.5 μm on a dry basis, and the coating was dried to form a plasticizer-resistant layer.

| | |
|---|---|
| Copolymer shown in Table A1 | 100 pts. wt. |
| Propylene glycol monomethyl ether | 100 pts. wt. |
| Methyl ethyl ketone | 25 pts. wt. |
| Ethanol | 25 pts. wt. |

TABLE A1

| | Formulation | | | | | | | | | | | |
|---|---|---|---|---|---|---|---|---|---|---|---|---|
| | MAc | AAc | HEMA | HEA | 9EGA | ST | MMA | EA | nBA | nBMA | iBMA | 2EHA |
| Ex. 1 | 10 | | 20 | | 1.0 | | 36.6 | 22.4 | | | 10 | |
| Ex. 2 | 20 | | 20 | | 1.0 | | 35.2 | 18.8 | | 5 | | |
| Ex. 3 | 30 | | 20 | | 1.0 | | 15.5 | 28.5 | | 5 | | |
| Ex. 4 | 40 | | | 20 | 1.0 | 5 | 18.0 | | 6.0 | | 10.0 | |
| Ex. 5 | | 20 | 20 | | 1.0 | | 35.7 | 18.3 | | 5 | | |
| Ex. 6 | 30 | | 15 | | 0.5 | | 17.3 | 27.2 | | 10 | | |
| Ex. 7 | 20 | | 15 | | 1.5 | | 29.6 | 23.9 | | 10 | | |
| Ex. 8 | 10 | | 25 | | 1.0 | | 49 | 5 | | 10 | | |
| Comp. Ex. 1 | | | | | | | 82.6 | 12.4 | | 5 | | |
| Comp. Ex. 2 | 2 | | 20 | | 1.0 | | 59.7 | 7.3 | | | 10 | |
| Comp. Ex. 3 | 60 | | | 20 | 1.0 | | 12 | | | | | 7 |
| Comp. Ex. 4 | 20 | | 2 | | 1.0 | | 62.4 | | 14.6 | | | |
| Comp. Ex. 5 | 20 | | 50 | | 1.0 | 19.4 | | 4.6 | | | 5 | |
| Comp. Ex. 6 | 10 | | 20 | | | | 49.9 | | 15.1 | 5 | | |

TABLE A1-continued

| | | | | | | | |
|---|---|---|---|---|---|---|---|
| Comp. Ex. 7 | 20 | 20 | 1.0 | 22.9 | | 10 | 26.1 |
| Comp. Ex. 8 | 40 | 20 | 1.0 | 38 | 1 | | |
| Comp. Ex. 9 | 20 | 20 | 1.0 | 43.4 | 15.6 | | |

| | TOTAL | Calculated Tg1 | Found Mw | Found Tg2 | Difference Tg2 − Tg1 |
|---|---|---|---|---|---|
| Ex. 1 | 100 | 60 | 38000 | 80 | 20 |
| Ex. 2 | 100 | 70 | 35000 | 105 | 35 |
| Ex. 3 | 100 | 60 | 37000 | 100 | 40 |
| Ex. 4 | 100 | 70 | 45000 | 115 | 45 |
| Ex. 5 | 100 | 60 | 33000 | 90 | 30 |
| Ex. 6 | 100 | 60 | 36000 | 95 | 35 |
| Ex. 7 | 100 | 60 | 42000 | 100 | 40 |
| Ex. 8 | 100 | 80 | 43000 | 105 | 25 |
| Comp. Ex. 1 | 100 | 80 | 40000 | 80 | 0 |
| Comp. Ex. 2 | 100 | 80 | 34000 | 85 | 5 |
| Comp. Ex. 3 | 100 | 80 | 52000 | 130 | 50 |
| Comp. Ex. 4 | 100 | 80 | 29000 | 105 | 25 |
| Comp. Ex. 5 | 100 | 80 | 55000 | 95 | 15 |
| Comp. Ex. 6 | 100 | 60 | 29000 | 75 | 15 |
| Comp. Ex. 7 | 100 | 30 | 58000 | 60 | 30 |
| Comp. Ex. 8 | 100 | 120 | 81000 | 150 | 30 |
| Comp. Ex. 9 | 100 | 80 | 21000 | 100 | 20 |

* Abbreviations of ingredients in Table
MAc: methacrylic acid,
AAc: acrylic acid,
HEMA: 2-hydroxyethyl methacrylate,
HEA: 2-hydroxyethyl acrylate,
9EGA: polyethylene glycol diacrylate (PEG #400 adduct: manufactured by Kyoeisha Chemical Co., Ltd.),
ST: styrene,
MMA: methyl methacrylate,
EA: ethyl acrylate,
nBA: n-butyl acrylate,
nBMA: n-butyl methacrylate,
iBMA: i-butyl methacrylate, and
2EHA: 2-ethylhexyl acrylate.

(Formation of Heat-Sensitive Adhesive Resin Layer)

A coating liquid for a heat-sensitive adhesive resin layer having the following composition was gravure coated on the plasticizer-resistant layer to a thickness of 1.5 μm on a dry basis, and the coating was dried to form a heat-sensitive adhesive resin layer.

| Composition of coating liquid for heat-sensitive adhesive resin layer | |
|---|---|
| Vinyl chloride-vinyl acetate copolymer (1000 ALK, manufactured by Denki Kagaku Kogyo K.K.) | 20 parts |
| Methyl ethyl ketone/toluene (weight ratio = 1/1) | 80 parts |

(Production of Printed Matter)

A thermal transfer film provided with a coloring material layer of yellow, a coloring material layer of magenta, and a coloring material layer of cyan was provided. An image was formed on a vinyl chloride card (85.5 mm in length×54.0 mm in width×0.8 mm in thickness) with a printer (card printer P310, manufactured by Eltron).

Next, each of the protective layer transfer films prepared in the Examples and Comparative Examples was put on top of the vinyl chloride card in its image forming part. The protective layer was transferred from the protective layer transfer film with a printer (card printer P310, manufactured by Eltron) so as to cover the image forming part to form a printed matter covered by the protective layer.

The cards thus obtained were evaluated for fastness to a plasticizer, fastness to abrasion, and transferability. The results are shown in Table A2.

(Evaluation)

(Evaluation for Fastness to Plasticizer)

The protective layer side of the printed matter prepared above was put on top of a flexible plasticizer-containing vinyl chloride sheet (Arutoron #480, manufactured by Mitsubishi Chemical Corporation, thickness 400 μm). A load of 70.2 g/m$^2$ was applied to the assembly, and the assembly was stored in an environment of 82° C. for 32 hr to visually observe damage to images caused by the plasticizer, and the results were rated as follows. The evaluation results are as summarized in Table A2.

○: Transfer of image onto vinyl chloride sheet was not observed at all.

Δ: Transfer of image onto vinyl chloride sheet was observed for a part of image.

X: Transfer of image onto vinyl chloride sheet was observed for the whole image.

(Evaluation for Fastness to Abrasion)

For the printed matters prepared above, a 300-revolution test was carried out with ROTARY ABRASION TESTER (manufactured by Toyo Seiki Seisaku Sho, Ltd.) under conditions of truck wheel CS-10 and load 500 g to visually evaluate fastness properties according to the following criteria. The results are summarized in Table A2.

[Evaluation Criteria]

○: No image breaking was observed.

Δ: Part of image was deteriorated.

X: Image breaking was observed.

TABLE A2

| | Fastness to plasticizer | Fastness to abrasion (scratch resistance) |
|---|---|---|
| Ex. 1 | ○ | ○ |
| Ex. 2 | ○ | ○ |
| Ex. 3 | ○ | ○ |
| Ex. 4 | ○ | ○ |
| Ex. 5 | ○ | ○ |
| Ex. 6 | ○ | ○ |
| Ex. 7 | ○ | ○ |
| Ex. 8 | ○ | ○ |
| Comp. Ex. 1 | X | X |
| Comp. Ex. 2 | Δ | X |
| Comp. Ex. 3 | X | Δ |
| Comp. Ex. 4 | X | ○ |
| Comp. Ex. 5 | Δ | Δ |
| Comp. Ex. 6 | Δ | Δ |
| Comp. Ex. 7 | Δ | X |
| Comp. Ex. 8 | X | ○ |
| Comp. Ex. 9 | Δ | Δ |

Example B

Preparation of Intermediate Transfer Recording Medium

Example B1 to Example B8 and Comparative Example B1 to Comparative Example B9

A 12 μm-thick transparent polyethylene terephthalate was first provided as a substrate film. A coating liquid for a peel layer having the following composition was coated on the surface of the substrate film, and the coating was dried to form a 1.0 μm-thick peel layer.

| (Coating liquid for peel layer) | |
|---|---|
| Acrylic resin | 40 pts. wt. |
| Polyester resin | 2 pts. wt. |
| Methyl ethyl ketone | 50 pts. wt. |
| Toluene | 50 pts. wt. |

Coating liquids for a plasticizer-resistant layer having the following composition were then prepared using copolymers synthesized according to formulations of Example B1 to Example B8 and Comparative Example B1 to Comparative Example B9 shown in Table B1.

| (Coating liquid for plasticizer-resistant layer) | |
|---|---|
| Copolymer shown in Table B1 | 100 pts. wt. |
| Propylene glycol monomethyl ether | 100 pts. wt. |
| Methyl ethyl ketone | 25 pts. wt. |
| Ethanol | 25 pts. wt. |

TABLE B1

| | Formulation | | | | | | | | | | | |
|---|---|---|---|---|---|---|---|---|---|---|---|---|
| | MAc | AAc | HEMA | HEA | 9EGA | ST | MMA | EA | nBA | nBMA | iBMA | 2EHA |
| Ex. 1 | 10 | | 20 | | 1.0 | | 36.6 | 22.4 | | | 10 | |
| Ex. 2 | 20 | | 20 | | 1.0 | | 35.2 | 18.8 | | 5 | | |
| Ex. 3 | 30 | | 20 | | 1.0 | | 15.5 | 28.5 | | 5 | | |
| Ex. 4 | 40 | | | 20 | 1.0 | 5 | 18.0 | | 6.0 | | 10.0 | |
| Ex. 5 | | 20 | 20 | | 1.0 | | 35.7 | 18.3 | | 5 | | |
| Ex. 6 | 30 | | 15 | | 0.5 | | 17.3 | 27.2 | | 10 | | |
| Ex. 7 | 20 | | 15 | | 1.5 | | 29.6 | 23.9 | | 10 | | |
| Ex. 8 | 10 | | 25 | | 1.0 | | 49 | 5 | | 10 | | |
| Comp. Ex. 1 | | | | | | | 82.6 | 12.4 | | 5 | | |
| Comp. Ex. 2 | 2 | | 20 | | 1.0 | | 59.7 | 7.3 | | | 10 | |
| Comp. Ex. 3 | 60 | | | 20 | 1.0 | | 12 | | | | | 7 |
| Comp. Ex. 4 | 20 | | 2 | | 1.0 | | 62.4 | | 14.6 | | | |
| Comp. Ex. 5 | 20 | | 50 | | 1.0 | 19.4 | | 4.6 | | | | |
| Comp. Ex. 6 | 10 | | 20 | | | | 49.9 | | 15.1 | 5 | | |
| Comp. Ex. 7 | 20 | | 20 | | 1.0 | | 22.9 | | | 10 | | 26.1 |
| Comp. Ex. 8 | 40 | | 20 | | 1.0 | | 38 | 1 | | | | |
| Comp. Ex. 9 | 20 | | 20 | | 1.0 | | 43.4 | 15.6 | | | | |

TABLE B1-continued

| | TOTAL | Calculated Tg1 | Found Mw | Found Tg2 | Difference Tg2 − Tg1 |
|---|---|---|---|---|---|
| Ex. 1 | 100 | 60 | 38000 | 80 | 20 |
| Ex. 2 | 100 | 70 | 35000 | 105 | 35 |
| Ex. 3 | 100 | 60 | 37000 | 100 | 40 |
| Ex. 4 | 100 | 70 | 45000 | 115 | 45 |
| Ex. 5 | 100 | 60 | 33000 | 90 | 30 |
| Ex. 6 | 100 | 60 | 36000 | 95 | 35 |
| Ex. 7 | 100 | 60 | 42000 | 100 | 40 |
| Ex. 8 | 100 | 80 | 43000 | 105 | 25 |
| Comp. Ex. 1 | 100 | 80 | 40000 | 80 | 0 |
| Comp. Ex. 2 | 100 | 80 | 34000 | 85 | 5 |
| Comp. Ex. 3 | 100 | 80 | 52000 | 130 | 50 |
| Comp. Ex. 4 | 100 | 80 | 29000 | 105 | 25 |
| Comp. Ex. 5 | 100 | 80 | 55000 | 95 | 15 |
| Comp. Ex. 6 | 100 | 60 | 29000 | 75 | 15 |
| Comp. Ex. 7 | 100 | 30 | 58000 | 60 | 30 |
| Comp. Ex. 8 | 100 | 120 | 81000 | 150 | 30 |
| Comp. Ex. 9 | 100 | 80 | 21000 | 100 | 20 |

* Abbreviations of ingredients in Table
MAc: methacrylic acid,
AAc: acrylic acid,
HEMA: 2-hydroxyethyl methacrylate,
HEA: 2-hydroxyethyl acrylate,
9EGA: polyethylene glycol diacrylate (PEG #400 adduct: manufactured by Kyoeisha Chemical Co., Ltd.),
ST: styrene,
MMA: methyl methacrylate,
EA: ethyl acrylate,
nBA: n-butyl acrylate,
nBMA: n-butyl methacrylate,
iBMA: i-butyl methacrylate, and
2EHA: 2-ethylhexyl acrylate.

A coating liquid for a plasticizer-resistant layer having the above composition was coated onto the peel layer, and the coating was dried to form a 2.0 μm-thick plasticizer-resistant layer.

A coating liquid for a receptive layer having the following composition was coated onto the plasticizer-resistant layer, and the coating was dried to form a 2.0 μm-thick receptive layer. Thus, an intermediate transfer recording medium comprising a separable protective laminate which is a laminate of a peel layer, a plasticizer-resistant layer, and a receptive layer was prepared.

| (Composition of coating liquid for receptive layer) | |
|---|---|
| Vinyl chloride-vinyl acetate copolymer | 40 pts. wt. |
| Acrylic silicone | 1.5 pts. wt. |
| Methyl ethyl ketone | 50 pts. wt. |
| Toluene | 50 pts. wt. |

Preparation of Card as Printed Matter

An image was formed by thermal transfer using a thermal transfer film comprising a yellow coloring material layer, a magenta coloring material layer, and a cyan coloring material layer provided in a face serial manner on the receptive layer in the intermediate transfer recording medium.

A vinyl chloride card and the intermediate transfer recording medium in its image formed part were then put on top of each other, followed by transfer by means of a heat roll to prepare a card as a printed matter.

The card thus obtained was evaluated for fastness to a plasticizer and fastness to abrasion, and the results are shown in Table 2.

(Evaluation)

(Evaluation for Fastness to Plasticizer)

A flexible plasticizer-containing vinyl chloride sheet (Arutoron #480, manufactured by Mitsubishi Chemical Corporation, thickness 400 μm) was put on top of the printed matter prepared above. A load of 70.2 g/m$^2$ was applied to the assembly, and the assembly was stored in an environment of 82° C. for 32 hr to visually observe damage to images caused by the plasticizer, and the results were rated as follows. The evaluation results are as summarized in Table B2.

○: Transfer of image onto vinyl chloride sheet was not observed at all.

Δ: Transfer of image onto vinyl chloride sheet was observed for a part of image.

X: Transfer of image onto vinyl chloride sheet was observed for the whole image.

(Evaluation for Fastness to Abrasion)

For the printed matters prepared above, a 300-revolution test was carried out with ROTARY ABRASION TESTER (manufactured by Toyo Seiki Seisaku Sho, Ltd.) under conditions of truck wheel CS-10 and load 500 g to visually evaluate fastness properties according to the following criteria. The results are summarized in Table B2.

[Evaluation Criteria]

○: No image breaking was observed.

Δ: Part of image was deteriorated.

X: Image breaking was observed.

TABLE B2

| | Fastness to plasticizer | Fastness to abrasion (scratch resistance) |
|---|---|---|
| Ex. 1 | ○ | ○ |
| Ex. 2 | ○ | ○ |
| Ex. 3 | ○ | ○ |
| Ex. 4 | ○ | ○ |
| Ex. 5 | ○ | ○ |
| Ex. 6 | ○ | ○ |
| Ex. 7 | ○ | ○ |
| Ex. 8 | ○ | ○ |
| Comp. Ex. 1 | X | X |
| Comp. Ex. 2 | Δ | X |
| Comp. Ex. 3 | X | Δ |
| Comp. Ex. 4 | X | ○ |
| Comp. Ex. 5 | Δ | Δ |
| Comp. Ex. 6 | Δ | Δ |
| Comp. Ex. 7 | Δ | X |
| Comp. Ex. 8 | X | ○ |
| Comp. Ex. 9 | Δ | Δ |

The invention claimed is:

1. A protective layer transfer film comprising: a substrate film; and at least a plasticizer-resistant layer provided on said substrate film, said plasticizer-resistant layer being formed of an acrylic copolymer resin produced by radically polymerizing (a) 4 to 50 parts by weight of (meth)acrylic acid, (b) 4 to 40 parts by weight of 2-hydroxyethyl (meth) acrylate, (c) 0.1 to 2 parts by weight of polyethylene glycol di(meth)acrylate, and (d) 8 to 91.9 parts by weight of an unsaturated bond-containing compound (other than components (a) to (c)) ((a)+(b)+(c)+(d)=100 parts by weight).

2. A protective layer transfer film comprising: a substrate film; and a thermally transferable protective layer provided on at least a part of one side of said substrate film, said protective layer comprising at least a plasticizer-resistant layer provided on said substrate film, said plasticizer-resistant layer being formed of an acrylic copolymer resin produced by radically polymerizing (a) 4 to 50 parts by weight of (meth)acrylic acid, (b) 4 to 40 parts by weight of 2-hydroxyethyl (meth)acrylate, (c) 0.1 to 2 parts by weight of polyethylene glycol di(meth)acrylate, and (d) 8 to 91.9 parts by weight of an unsaturated bond-containing compound (other than components (a) to (c)) ((a)+(b)+(c)+(d) =100 parts by weight).

3. The protective layer transfer film according to claim 1, wherein said acrylic copolymer has a glass transition temperature (Tg1) of 50 to 90° C. as calculated from the monomer composition and the difference between the glass transition temperature (Tg1) and a glass transition temperature (Tg2) as measured with a differential scanning calorimeter (DSC) (Tg2−Tg1) is 20° C. or above.

4. A printed matter produced by thermally transferring a protective layer in the protective layer transfer film according to claim 1 onto an image in a printed matter.

5. The printed matter according to claim 4, wherein the image in the printed matter has been formed by any one of electronic photography, ink jet recording, and thermal transfer recording.

6. An intermediate transfer recording medium comprising: a substrate film; and a transfer part provided separably on said substrate film, said transfer part comprising at least a plasticizer-resistant layer and a receptive layer on which an image is to be formed, said intermediate transfer recording medium being adapted for the transfer of said transfer part onto an object after the formation of an image on said receptive layer, said plasticizer-resistant layer being formed of an acrylic copolymer resin produced by radically polymerizing (a) 4 to 50 parts by weight of (meth)acrylic acid, (b) 4 to 40 parts by weight of 2-hydroxyethyl (meth)acrylate, (c) 0.1 to 2 parts by weight of polyethylene glycol di(meth) acrylate, and (d) 8 to 91.9 parts by weight of an unsaturated bond-containing compound (other than components (a) to (c)) ((a)+(b)+(c)+(d)=100 parts by weight).

7. The protective layer transfer film according to claim 6, wherein said acrylic copolymer has a glass transition temperature (Tg1) of 50 to 90° C. as calculated from the monomer composition and the difference between the glass transition temperature (Tg1) and a glass transition temperature (Tg2) as measured with a differential scanning calorimeter (DSC) (Tg2−Tg1) is 20° C. or above.

8. A printed matter produced by forming an image on the intermediate transfer recording medium according to claim 6 and then transferring said transfer part onto an object.

9. The printed matter according to claim 8, wherein the image in the printed matter has been formed by any one of electronic photography, ink jet recording, and thermal transfer recording.

* * * * *